United States Patent [19]

Kirschmann et al.

[11] Patent Number: 4,691,850

[45] Date of Patent: Sep. 8, 1987

[54] CHEMICAL DISPENSING SYSTEM

[76] Inventors: John D. Kirschmann, 933 Anderson St., Bismarck, N. Dak. 58501; John P. Soberg, 1280 W. Larpenteur Ave., St. Paul, Minn. 55113

[21] Appl. No.: 639,248

[22] Filed: Aug. 9, 1984

[51] Int. Cl.[4] ..... G04C 23/00

[52] U.S. Cl. ..... 222/642; 222/144.5; 222/145; 222/148

[58] Field of Search ..... 222/145, 148, 144.5, 222/133, 135, 136, 639, 642; 137/217; 239/112; 417/417; 134/169 R, 169 C, 166 R, 166 C; 422/116, 62

[56] References Cited

U.S. PATENT DOCUMENTS

| | | | |
|---|---|---|---|
| 2,823,833 | 2/1958 | Bauerlein | 137/217 |
| 2,955,726 | 10/1960 | Feldman . | |
| 3,251,508 | 5/1966 | Borys . | |
| 3,268,119 | 8/1966 | Kopera . | |
| 3,540,982 | 11/1970 | Sepall | 422/116 |
| 3,595,438 | 7/1971 | Daley . | |
| 3,635,601 | 1/1972 | Larson . | |
| 3,680,070 | 7/1972 | Nystuen . | |
| 3,877,682 | 4/1975 | Moss . | |
| 3,951,311 | 4/1976 | Johansson . | |
| 3,960,295 | 6/1976 | Horak . | |
| 4,084,237 | 4/1978 | Beachem . | |
| 4,090,475 | 5/1978 | Kwan | 222/148 |
| 4,242,051 | 12/1980 | Mason . | |
| 4,285,445 | 8/1981 | Vander Molen et al. | 222/148 |
| 4,512,764 | 4/1985 | Wunsch | 222/145 |
| 4,556,011 | 12/1985 | Tarr | 222/135 |

FOREIGN PATENT DOCUMENTS

| | | | |
|---|---|---|---|
| 1383935 | 2/1975 | United Kingdom | 417/417 |

*Primary Examiner*—H. Grant Skaggs

*Attorney, Agent, or Firm*—Moore & Hansen

[57] ABSTRACT

A dispenser for the mixing and dispensing of chemicals is provided which utilizes a draw-through distribution manifold connected to a number of concentrated chemical base solution containers. Solenoids corresponding to each chemical base are selectively operable to allow one chemical at a time to run through the manifold and a pump connected to the manifold outlet to be mixed with water from a general solenoid valve. A system for flushing the manifold is provided wherein a flush port is provided at the opposite end of the distribution manifold from its outlet. After each chemical has run for a period through the manifold, the flush system operates to accurately dilute the dispensed chemical and flush the manifold.

20 Claims, 6 Drawing Figures

CHEMICAL DISPENSING SYSTEM

BACKGROUND OF THE INVENTION

Chemicals such as those used in cleaning have typically been provided in several fashions. First, such chemicals can be provided in concentrations and combinations of ingredients appropriate to end use. The problem with this method of distribution is the large numbers of separate mixtures which are appropriate for various uses as well as the large amount of volume and weight required for storing and shipping of these chemicals due to the substantial amount of water which is present in any end use chemical.

One method of solving the volume and weight problem is to provide the chemical in concentrated form thereby allowing the end user to appropriately dilute the solution as desired. While this approach may seem attractive, such dilution can cause problems in that it is hard to get the appropriate exact dilutions required for various applications, such as cleaning. Solutions which are too concentrated or too dilute may be equally unsuitable.

Various mixing devices have been known in the art, and such devices are shown in general in U.S. Pat. Nos. 2,955,726, 3,977,682, 3,251,508, 3,951,311, 3,960,295 and 3,268,119. While the devices disclosed in these patents may be somewhat effective in accomplishing their intended purposes, none is suited to end use mixing of multiple ingredient products at a cost which is feasible for end users. In particular, none of these shows the draw-through manifold and single pump arrangement of the instant invention nor shows the other inventive features as described and claimed hereinafter.

Obviously the same sort of desired result is accomplished on a large scale in chemical processing plants on an every day basis. However, such machinery is quite expensive and substantially more complicated than is required for the intended use set forth hereinafter.

It is, therefore, an object of this invention to provide a dispensing device which is capable of mixing chemical bases in an exact fashion which provides exact amounts of each ingredient desired in combination with the appropriate dilution of water or other solvent which is basic to all of the chemical components.

It is further an object of this invention to provide a chemical mixing system which is reasonably compact and inexpensive to manufacture so as to be suited for an end use situation.

SUMMARY OF THE INVENTION

The instant invention is designed for use in mixing various super-concentrated base fluids along with a flush fluid to form an end use product. As used herein, the term, "flush fluid", is defined broadly to include all such fluids which are used to dilute the various ingredient bases. For example, in the embodiment which utilizes various cleaning fluids as will be discussed hereinafter, water is the flush fluid used to dilute the various liquid bases. The flush fluid may also be a mixture of ingredients such as an alcohol-water mixture.

It can be appreciated that in other applications where there might be an oil base, a liquid such as mineral spirits might be the flush fluid which is used to mix and dilute with the various ingredients which could conceivably be various paint colors or the like. It should also be apparent that the term, "base" as defined herein is not used to refer to base in the alkaline sense, but rather base in the sense of a fundamental ingredient.

Lines run from containers full of each of the constituent bases to a distribution manifold which is preferably arranged in a linear fashion. It can be appreciated that other manifold arrangements may be utilized such as a rotary arrangement. Electrically actuated solenoid valves control communication between the inlet ports from the constituent chemicals and a central passage in the distribution manifold. A pump is connected to the outlet end of the central passage and that pump is desirably an oscillating leaf spring pump which draws the selected ingredients through the manifold and thence to an outlet manifold whereupon the metered amounts are mixed with pressurized water (or other chosen flush fluid) flowing at a known fixed rate.

A flush port and associated solenoid are located at the opposite end of the distribution manifold from the outlet, the ports for the constituent ingredients being located between the two. A water valve solenoid having flow control associated therewith is connected to the inlet of the outlet manifold. Connected to the outlet manifold next to the inlet is a flush tube in fluid flow communication with the flush port. The flush tube has a check valve located therein which prevents back flow from the distribution manifold to the outlet manifold directly through the flush tube.

Connected to the outlet manifold is a dump line having a check valve therein. The dump line is open to the atmosphere at one end and the valve allows flow only from the atmosphere into the outlet manifold. Lastly, connected to the outlet manifold is the output of the pump set forth above.

The dump check valve in the outlet manifold serves an important purpose. After the pump has shut off at the end of the dispensing cycle, typically a substantial amount of fluid will remain in the outlet manifold and in the dispensing tube. Because this line is, of course, fluid tight, the fluid remains such that the next time fluid is dispensed, undesirable or incompatible elements might be mixed together. By providing the check valve, oncepressure in the outlet manifold has been relieved, air is allowed to flow into the outlet manifold and dispensing tube, thus allowing a substantial remainder of fluid therein to dump such that the deleterious mixing does not take place. The particular arrangement of parts in the outlet manifold is important as such arrangement allows the most advantageous functioning of the svstem. In particular, the provision of the air check dump valve downstream of the flush tube inlet allows the flush tube to receive fluid from out of the water supply valves without having air mixed therewith. In other words, the continual pressured supply of water into the outlet manifold always provides water which has not been mixed with air into the flush tube which is important to maintain a proper flow through the tube. The provision of the air dump valve upstream of the pump output helps in the dumping action.

A check valve is also located between the water solenoid and the outlet manifold to prevent flow back into the water supply should the water pressure drop.

The control system is arranged to provide a cycling of the various components so as to provide the best mixing and dispensing of the ingredients. For example, if ingredient A is pumped for two seconds, then water is provided through the flush tube for a further several seconds before the solenoids then switch over to ingredient B for two seconds. This provision of cycling allows ingredients A and B to be mixed, but in a proper way. For instance, while ingredients A and B may be ultimately compatible and mixable in dilute form, it is not uncommon that such ingredients are not easily mixable in super-concentrated form. Thus, if ingredient B immediately followed ingredient A, the mixture of the two in the distribution manifold and the pump could for instance turn into a highly viscous gel which would then not be pumped accurately. By first dispensing ingredient A and thence flushing with water before pumping ingredient B, the various components are diluted to a point where they may be properly mixed, the mixing taking place downstream of the pump such that amounts are then accurately metered. Also, it should be noted that the last solenoid to open during the dispensing cycle is always the flush solenoid which allows the water to flush the manifold and pump and provide proper dilution. This flushing is part of the dispensing action and completely removes the need for any sort of manual cleaning between dispensing cycles.

The control mechanism is also arranged so that one of the distribution manifold solenoid valves is always open, yet only one such valve is open at a time. Such an arrangement allows the dump and distribution manifold to always be filled with one liquid or another. This constant filling allows the pump to operate continuously and at a constant rate thereby imparting a highly accurate pumping and metering system.

The dispensing system of the instant invention, while disclosing an embodiment tailored for cleaning chemicals, is also suited for any number of other uses. For example, the system could be utilized to manufacture various combination chemicals. While the system simplicity suits it to end use applications, system accuracy broadens the possible uses.

These and other objects and advantages of this invention will appear more fully from the following description made in conjunction with the accompanying drawings wherein like reference characters refer to the same or similar parts throughout the several views.

DESCRIPTION OF THE DRAWING FIGURES

DESCRIPTION OF THE PREFERRED EMBODIMENT

Figure 1:
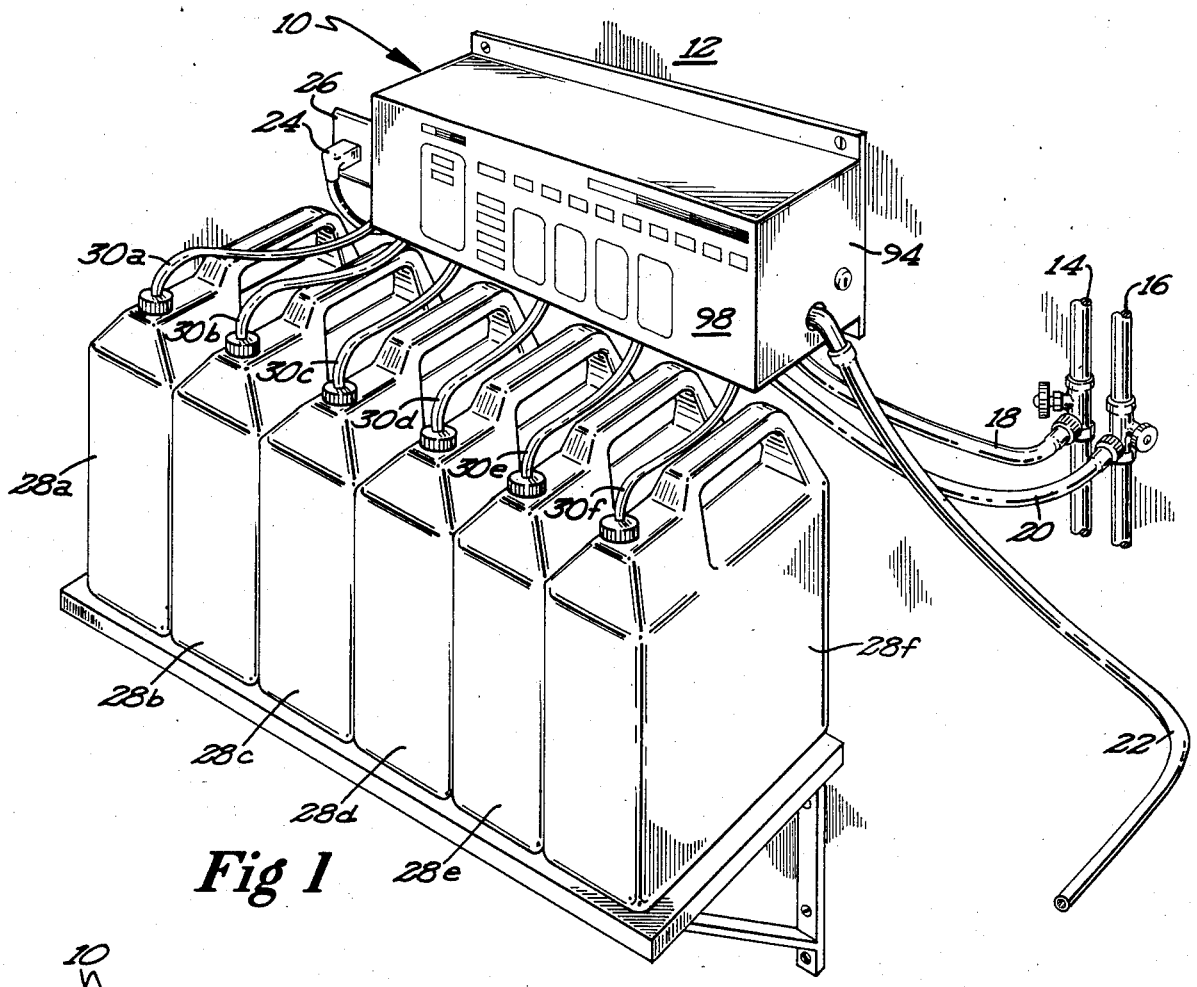
FIG. 1 is a perspective view showing the dispenser of the instant invention mounted on a wall.

The dispenser 10 of the instant invention is shown generally in FIG. 1 as being mounted to a wall 12. While the dispenser 10 is shown as being mounted to a wall 12, it can be appreciated that dispenser 10 may also be mounted portably on a cart or as part of a free-standing cabinet. Dispenser 10 is designed for connection to sources of hot and cold water 14 and 16, respectively, by means of conventional hoses 18 and 20 as shown. A dispensing outlet tube 22 is shown extending out of the right side of dispenser 10. Dispensing tube 22 is preferably formed of a clear plastic tubing which may be placed in a bucket or bottle into which the finished product will be dispensed.

A power cord 24 is used to connect dispenser 10 to a convention source of power 26. Six bottles 28 of concentrated bases, i.e. 28*a*–28*f*, are placed beneath dispenser 10. Corresponding intake tubes 30*a*–30*f* extend into the bottles 28 of concentrate and are connected inside dispenser 10 as will be described hereinafter. Also as will be set forth more fully hereinafter, any number of bases 28 may be utilized on the particular combination in which they will be made. For purposes of discussion, six such bases will be utilized and discussed herein.

A water solenoid 32 is provided within dispenser 10 and has attached thereto hot and cold water hoses 18 and 20, respectively. Hoses 18 and 20 are hooked to hot and cold sides 32*a* and 32*b* of water solenoid 32 which are able to open upon command and dispense hot and/or cold water through solenoid outlet 32*c*. Water solenoid 32 is provided with a flow control mechanism so as to provide a constant flow volume regardless of the inlet pressure. Such flow control mechanisms are well known and those manufactured by the Eaton Corporation in the form of a washer are suitable for the use intended. A water inlet check valve 34 is attached to solenoid outlet 32*c* and serves to prevent the back flow of chemical into the water supply 18 and 20 should the water pressure drop.

Connected to water check valve 32 is outlet manifold 36, and in particular check valve 34 is connected to outlet manifold inlet 36*a*. Arranged serially along the top of outlet manifold 36 are flush water outlet 36*b*, air dump inlet 36*c* and chemical inlet 36*d*. A dispensing outlet 36*e* is provided and has attached thereto the dispensing tube 22 described above. Attached to flush tube outlet 36*b* is flush tube 38 which has located therein a check valve 40 which allows flow only in the direction indicated away from distribution manifold 36 so as to prevent unwanted chemical backup through flush tube 38.

Figure 2:
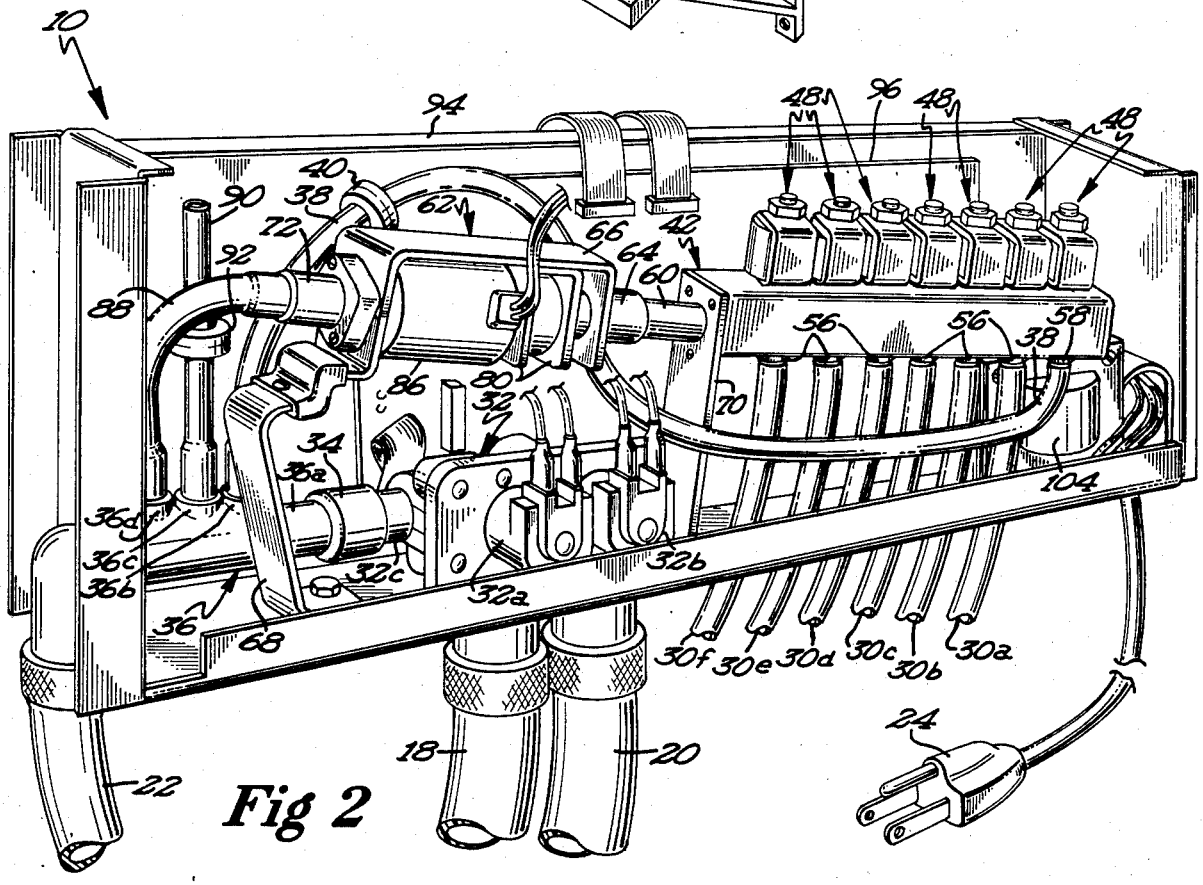
FIG. 2 is a perspective view of the dispensing device from the rear with cover removed.
Figure 3:
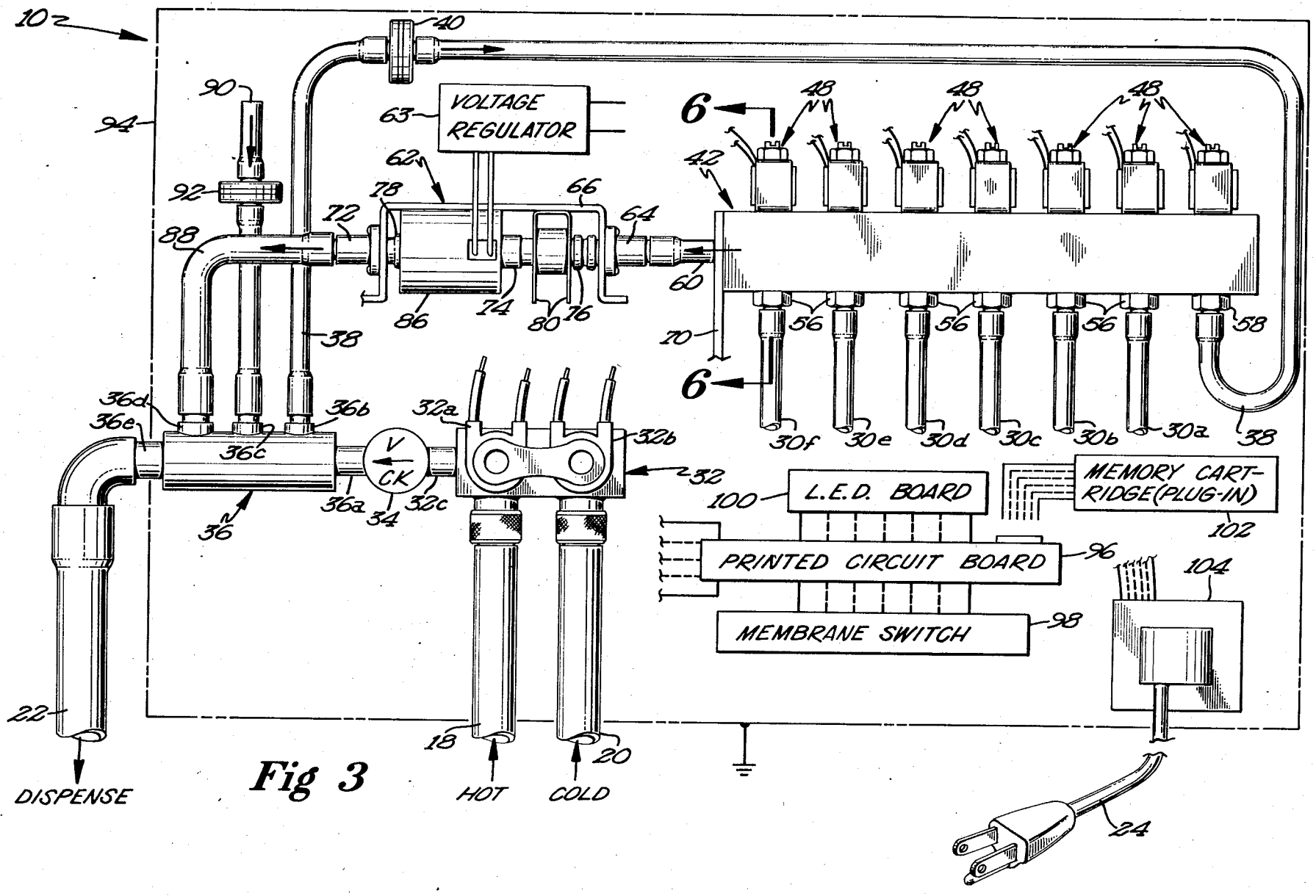
FIG. 3 is a schematic representation of the dispensing device.
Figure 6:
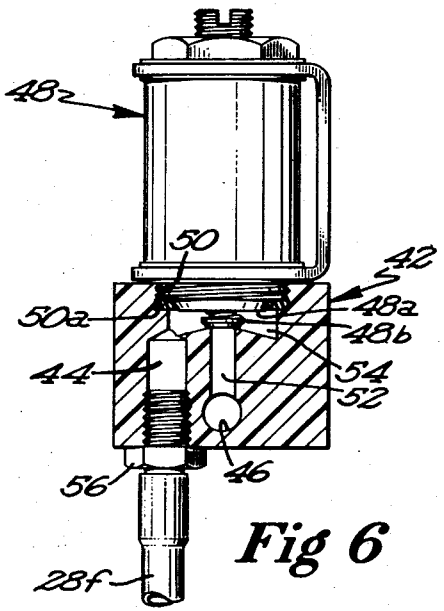
FIG. 6 is a sectional view taken along line 6—6 of FIG. 3.

A distribution manifold 42 is shown in general in FIGS. 2 and 3 and in sectional view in FIG. 6. In the preferred embodiment, distribution manifold 42 is formed from a single block of material. As shown in FIG. 6, inlet passages 44 are drilled upwardly from the bottom of manifold 42. A central passage 46 extends generally the length of manifold 42 as shown in FIG. 6. A plurality of solenoids 48 are located in the top of distribution manifold 42 and are located in holes 50 therein. A shoulder 50*a* in hole 50 forms a seating place for the bottom edge 48*a* of solenoid 48. A connecting passage 52 connects the bottom of solenoid hole 50 with central passage 46. Solenoid plunger 48*b* retractingly covers passage 52 to allow flow to be selectively chosen from a particular inlet passage 44. Solenoid 48 is spring loaded with the plunger out so that it normally occludes flow through passage 52. Upon energization, solenoid plunger 48*b* retracts thereby allowing flow consecutively through inlet passage 44, hole 50 and passages 52 and 46. An annular area 54 is formed around plunger 48*b* through which the fluid is able to flow.

In particular, the solenoids in the preferred embodiment are Brunswick Technetics Predyne Mini Series G. Such solenoid valves have a response time of three to five milliseconds. In such a system as the instant invention, this response time is for all intents and purposes instantaneous and thus, the pump has no chance to ingest air and thus pump inaccurately.

A plurality of inlet ports 56 are attached to an inlet passage 44 on the bottom of distribution manifold 42 for attachment to inlet hoses 30*a*–30*f*. A flush port 58 is mounted in distribution manifold 42 and has attached thereto flush tube 38. As will be set forth more fully hereinafter, flush port 58 is located at the opposite end of distribution manifold 42 from manifold outlet 60, the various ports 56 for mixing of chemicals being located therebetween.

Figure 5:
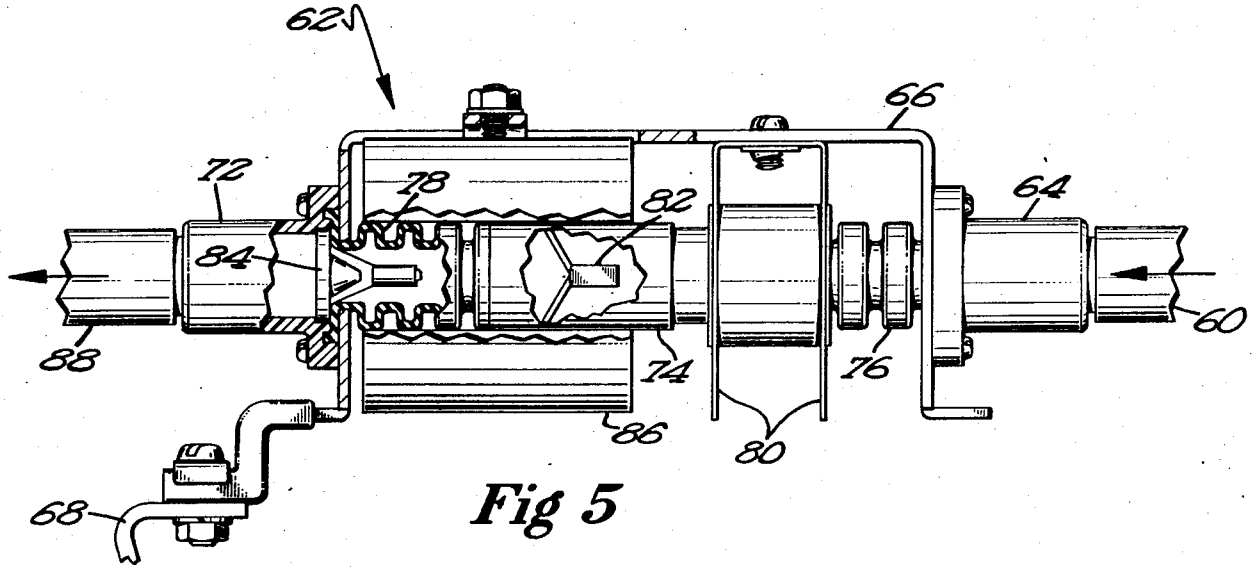
FIG. 5 is a detailed view of the pump utilized in the instant invention.

Pump 62 is attached to the outlet 60 of distribution manifold 42. Pump 62 is of the draw-through type and is shown in detail in FIG. 5. Pump 62 has an inlet 64, a frame 66 and a pump support 68. As shown, support 68 causes pump 62 to slant upwardly from inlet 64 to outlet 72. Such angled attitude helps prevent the ingestion or formation of bubbles in the pump. Such bubbles can decrease metering accuracy. Similarly, distribution manifold 42 is supported by means of a manifold support 70 located at the outlet end thereof. Pump 62 also has an outlet 72 located on the other end thereof. Pump 62 has a longitudinal impeller assembly slidingly located therein, impeller 74 having bellows 76 and 78 at either end thereof. Impeller 74 is mounted in a U-shaped spring assembly 80, the legs thereof allowing impeller 74 to move axially in a vibrating fashion. A duck-bill valve 82 is located inside of impeller 74 while a second outlet duck-bill valve 84 is located adjacent the outlet 72 of pump 62. A coil 86 is located around impeller 74, and when excited, coil 86 causes impeller 74 to vibrate longitudinally, thereby inducing a pumping action through valves 82 and 84. A pump outlet line 88 is attached to the outlet 72 of pump 62. Outlet line 88 is thereafter attached to port 36*d* of outlet manifold 36.

The Gorman-Rupp leaf spring oscillating pump, Model 14825, is particularly suited for use in the instant invention when it is modified and combined as described in the instant application. In particular, as modified and combined, this pump is capable of great accuracy in pumping fluids over a long period of time, and it is not subject to variations due to wear as is the case with other types of pumps such as diaphragm pumps. Such oscillating pumps have not been perceived as being accurate in the past due to the fact that pumping volume varies substantially depending upon the input voltage applied to the pump. Variations in pumping volume of as much as 200% could be found with a nominal line voltage of 120 volts.

A further contribution to accuracy is accomplished by providing that during a dispensing cycle, the pump runs continuously. While the various solenoids may switch and change the liquid which is pumped through the pump, the continuous running of the pump prevents variations in volume due to pump startup and shutdown thereby allowing the pump to operate at a constant known level.

The voltage regulator 63 connected to pump 62 is of the ramp and pedestal type which is generally well known for purposes of voltage regulation. In particular, it is more effective to regulate the voltage at 108 volts which is the lowest level to which line voltage will normally reach. It is easier and more efficient to always reduce the line voltage rather than to try to bring part of it up and the other down and the other part down to some intermediate value between 108 and 120 volts. By regulating to 108 volts and winding the coil and the pump accordingly, great accuracy can be attained such that the pump output varies no more than 3%–5% over any period of time.

An air dump line 90 is located and attached to dump port 36*c* on outlet manifold 36. An air dump check valve 92 is located in dump line 90 allowing passage only in the downward direction indicated by the arrows in FIG. 3.

Figure 4:
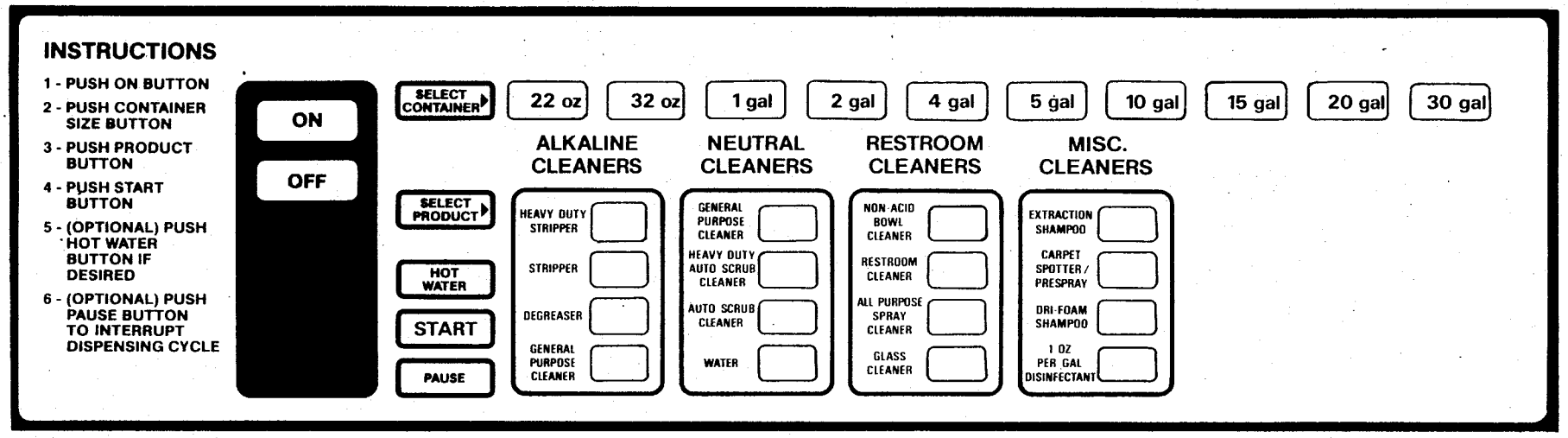
FIG. 4 is a view of the control panel of the dispensing device.

Of course, a general frame 94 as shown in FIG. 2 contains the various parts of dispenser 10 as set forth heretofore. A circuit board 96 contains generally conventional microprocessor electronics which provide control functions as set forth more fully hereinafter in the description of the operation. An LED board is mounted to the frame 94, such LED's indicating operation after the punching of the various buttons on membrane switch 98. The details of membrane switch 98 are shown in FIG. 4. Again, membrane switches are well known in general and hence, not the subject of this invention. A memory cartridge 102 may be plugged into circuit board 96, memory cartridge 102 having the ability to be programmed for different mixtures of chemicals and uses thereof to allow the same general apparatus to be utilized in a number of different product areas. Lastly, of course, a power supply 104 supplies the proper levels of power for the various components described heretofore.

The following table shows examples of the various proportions which are utilized of the various bases in forming finished cleaning products:

| PRODUCT | BASE #1 ALKALINE | BASE #2 NEUTRAL | BASE #3 RESTROOM | BASE #4 ALCOHOL | BASE #5 CARPET | BASE #6 DISINFECTANT |
|---|---|---|---|---|---|---|
| ALKALINE CLEANERS | | | | | | |
| Heavy Duty Stripper | 1:30 | 1:75 | | | | |
| Stripper | 1:40 | 1:100 | | | | |
| Degreaser | 1:80 | 1:200 | | | | |
| General Purpose Cleaner | 1:300 | 1:300 | | | | |
| NEUTRAL CLEANERS | | | | | | |
| General Purpose Cleaner | | 1:200 | | | | |
| H D Auto Scrub | | 1:100 | | | | |
| Auto Scrub Cleaner | | 1:125 | | | | |
| Water | | — | | | | |
| REST ROOM CLEANERS | | | | | | |
| Non-Acid Bowl Cleaner | | 1:15 | 1:20 | 1:10 | | |
| Rest Room Cleaner | | 1:30 | 1:40 | 1:10 | | |
| All Purpose Spray Cleaner | | 1:60 | 1:80 | 1:05 | | |
| Glass Cleaner | | 1:450 | 1:600 | 1:10 | | |
| MISCELLANEOUS CLEANERS | | | | | | |
| Extraction Shampoo | | 1:375 | 1:75 | | | |
| Carpet Spotter/Prespray | | 1:140 | 1:50 | 1:10 | | |
| Dry Foam Shampoo | | | | | 1:64 | |

-continued

| PRODUCT | BASE #1 ALKALINE | BASE #2 NEUTRAL | BASE #3 RESTROOM | BASE #4 ALCOHOL | BASE #5 CARPET | BASE #6 DISINFECTANT |
|---|---|---|---|---|---|---|
| 1 Oz./Gal. Disinfectant | | | | | | 1:128 |

OPERATION OF THE INVENTION

In actual operation, the dispenser of the instant invention is quite easy to use. Initially, the operator presses the "on" switch on membrane switch 98 and thereafter selects the size of container which will be utilized and presses the appropriate button. The operator then places dispensing tube 22 in the container and thence selects the product button of the product desired. When ready, the operator then presses the "start" button.

Upon the "start" button being pressed, water solenoid 32 opens and typically utilizes cold water from hose 20 through cold side 32*b*. As can be seen on membrane switch 98, if hot water is desired, that button may be pressed thereby allowing hot side 32*a* to open instead of cold side 32*b*. Water solenoid 32 is opened and runs the whole time during the dispensing operation, the pressure therein providing a source of water for flush tube 38.

Also upon pressing the "start" button, pump 62 starts and runs continuously until the product dispensing cycle is completed. For example, if the product chosen has three ingredients, the solenoid 48 corresponding to the first ingredient would open thereby allowing the pump 62 to draw the ingredient out of bottle 28 through hose 30 and thence through ports 44, 54, 52 and 46, consecutively, to outlet 60 and thence through pump 62 and on through pump outlet tube 88 and into outlet manifold 36, and thence through dispensing tube 22. When the allotted amount of the first chemical has been dispensed, then solenoid 48 closes and the flush solenoid 48 controlling flush port 58 opens causing water to flush through and run the length of manifold central passage 46 thereby cleaning out any traces of the prior chemicals. A flush time of six seconds has generally been found to be optimum in the instant invention.

Thence, the solenoid corresponding to the second chemical is opened and the flush solenoid closed simultaneously and the process repeated. After the second chemical has been dispensed, the flush solenoid opens again and the chemical solenoid closes, again flushing the manifold. Some products utilize three different bases, and if that is the case, the third chemical is then added and flushed thereafter.

When the flush cycle is completed, pump 62 shuts off. At this point, water solenoid 32 also shuts off leaving typically some amount of liquid remaining in outlet manifold 36 and dispensing tube 22. At this point, the lack of pressure in outlet manifold 36 allows dump tube 90 and dump check valve 92 to open, thereby allowing air into the outlet manifold and the remaining fluid to drain into the container being filled.

Preferably, at the beginning of the dispensing cycle, the flush solenoid 48 controlling flush port 58 is opened first and allowed to flush for a bit before any of the ingredient solenoids are opened. This permits water to be dispensed during the time when the pump is starting up and its pumping accuracy is not the best. Shortly after the pump has started and reached its stable operating level, the first ingredient may then be switched on. In the event the chemical to be dispensed is highly concentrated, it may be necessary that this initial flushing step be dispensed with.

Because the various liquid bases have varying viscosities and other flow characteristics, it is important that the control mechanism take these varying rates into account in controlling the time of pumping and the amount of fluid pumped.

By way of more particular example, suppose the operator desires to make two gallons of degreaser-type alkaline cleaner. This cleaner utilizes the alkaline and neutral bases as shown in the accompanying table and in particular dilutes those to strengths of 1 in 80 and 2 in 100, respectively. For a total of two gallons, this results in amounts of 3.2 ounces of alkaline base, 1.2 ounces of neutral base and 251.52 ounces of water. Further by way of example, if the pump 62 will pump the alkaline base at a rate of 0.56 ounces per second and the neutral base at a rate of 0.94 ounces per second, that calls for a solenoid associated with the alkaline base to be open for a total of 5.7 seconds and the solenoid associated with the neutral base to be open for a total of 1.3 seconds. If water solenoid 32 will flow at a rate of 448 ounces per minute, solenoid 32 will be open for a total of 33.69 seconds. In operation of the example then, water solenoid 32 would be open for a total of 33.69 seconds. At the same time as water solenoid 32 opens, pump 62 would start with the flush solenoid 48 controling flush port 58 being open initially. After a short period, the alkaline base solenoid might open for a period of 2.85 seconds, dispensing half of the alkaline ration. The alkaline solenoid would then close and the flush solenoid would open for a short period while then the neutral solenoid would open for 0.68 seconds dispensing half of the neutral base portion. That process would then be repeated providing that a final flush time of at least six seconds were provided until the total water solenoid time 32 had been completed.

For purposes of understanding the dispensing system set forth herein, the term "dispensing cycle" is intended to embrace one complete dispensing operation, whether one chemical or a plurality of chemicals are being dispensed. Thus, if only one chemical is being dispensed in proper diluted concentration with flush fluid (water), then the dispensing cycle would comprise the initial flush, then the dispensing of at least one chemical, and then the final flush. If more than one chemical is to be dispensed for a particular application, then a full dispensing cycle would include the initial flush, the dispensing of the first chemical, a further flush, then the dispensing of the second chemical, followed by a final flush.

While the preferred embodiments of the present invention have been described, it should be understood that various changes, adaptions and modifications may be made therein without departing from the spirit of the invention and the scope of the appended claims.

What is claimed is:

1. A system for mixing chemical solutions comprising:

a distribution manifold comprising:

a main passage;

a plurality of inlet ports connected to said passage;

an outlet connected to said passage; and a flush port, said flush port being operatively connected to a supply of flush fluid;

a pump having an inlet and an outlet, said pump inlet being connected to said manifold outlet to draw solutions through said manifold and said pump;

selectively controllable valve means associated with at least one of said ports; and an outlet manifold comprising an inlet connected to a source of pressurized flush fluid, a flush outlet from said manifold connected in fluid flow communication to said flush port, a dispensing outlet, and a fluid inlet connected to said pump outlet to receive fluid discharged by said pump.

2. The system of claim 1, said outlet manifold further comprising an air inlet, said air inlet having a check valve associated therewith allowing flow only in a direction into said outlet manifold.

3. The system of claim 2 wherein said flush outlet is adjacent said flush fluid source inlet, said fluid inlet is adjacent said dispensing outlet and said air inlet is intermediate said fluid inlet and said flush outlet.

4. The system of claim 1 wherein said pump is a constant displacement pump.

5. The system of claim 1 wherein said pump is an oscillating pump.

6. The system of claim 5 further comprising means for supplying a constant voltage to said pump.

7. The system of claim 1 wherein:

said main passage of said distribution manifold has first and second ends, said plurality of inlet ports are connected to said passage intermediate said ends, said outlet of said distribution manifold is at said passage second end, and said flush port is at the opposite, first end of said distribution manifold.

8. The system of claim 1 wherein:

selectively controllable valve means are operatively associated with each of said inlet ports and said flush port.

9. The system of calim 1 wherein:

a reservoir of concentrated liquid chemical is connected by a fluid supply line to each of said inlet ports.

10. A system for mixing chemicals comprising:

a distribution manifold comprising:

a main passage;

a plurality of chemical fluid inlet ports connected to said passage; and an outlet connected to said passage;

a pump having an inlet and an outlet, said pump inlet being connected to said manifold outlet to draw solution through said manifold and said pump;

selectively controllable valve means associated with each of said ports;

a source of diluting flush fluid;

fluid passage means placing said source of diluting flush fluid flow communication with chemical fluids discharged from said pump for the dilution of such fluids at a location downstream from said pump outlet, said fluid passage means having a dispensing outlet;

an automatically operable flush fluid control valve in said fluid passage means regulating the input flow of flush from said source thereof;

control means operatively associated with said pump, said selectively controllable valve means and said flush fluid control valve to operate same automatically in response to a preselected volume, sequential combination and concentration of chemical fluids to discharge the desired volume and combination of chemical fluids by said pump into said fluid passage means and to dilute said chemical fluids to the preselected concentration by providing a predetermined volume flow of flush fluid into admixture therewith through said flush fluid control valve.

11. The system of claim 10, said control means further being constructed and arranged to control and supply various pre-set volumes, combinations and concentrations of concentrated chemicals.

12. The system of claim 10 wherein said control means causes said pump to operate continuously during a dispensing cycle.

13. The system of claim 12 wherein said control means allows only one of said valves to open at a time and one of said valves is always open during said dispensing cycle.

14. The system of claim 10 wherein said pump is a constant displacement, oscillating pump.

15. A system for mixing and dispensing chemical solutions comprising:

a distribution manifold comprising:

a main passage;

a plurality of inlet ports connected to said passage for the selective flow of chemical fluids into said passage;

an outlet connected to said passage; and a flush port, said flush port being operatively connected to a pressurized supply of diluting flush fluid;

pump means having an inlet and an outlet, said pump means inlet being connected to said manifold outlet to draw solutions through said manifold, and said pump means outlet being connected to a dispensing outlet;

selectively controllable valve means operatively associated with each of said inlet ports and said flush port;

control means, said control means operating said valve means in a predetermined sequence, and said control means being operatively associated with said valve means associated with said flush port to open said flush port for a period following each opening of one of the other said valve means associated with said chemical fluid inlet ports;

fluid passage means placing said supply of flush fluid in fluid flow communication with chemical fluids discharged from said pump means for the dilution of chemical fluids at a location downstream from said pump means outlet; and a main diluting flush fluid control valve in said fluid passage means, and said control means being operatively associated with said main flush fluid control valve to provide a predetermined volume of flush fluid through said fluid passage means to achieve a desired dilution of chemical fluids discharging from said pump means.

16. The system of claim 15 wherein said control means opens said valve means associated with said flush port prior to opening any other of said valve means at the beginning of a dispensing cycle.

17. The system of claim 15 wherein said control means comprises a control panel having switch means operatively connected to said valve means enabling an operator to select from a number of predetermined choices the type of chemical solution, concentration of chemical solution, and volume of chemical solution to be dispensed.

18. The system of claim 15 wherein said flush port is separately connected by conduit means to said source of flush fluid.

19. The system of claim 18 wherein said flush port conduit means is connected in said flow passage means downstream of said main flush fluid control valve.

20. A method of mixing and diluting concentrated chemicals in a dispensing cycle comprising the sequential dispensing steps of:

drawing a predetermined amount of a first concentrated chemical from a supply container thereof through a selectively controllable valve means and thence through a distribution manifold by pump means connected to an outlet of said manifold and into outlet passage means;

simultaneously metering a measured amount of a diluting fluid through fluid passage means into fluid flow communication with said first concentrated chemical in said outlet passage means for the dilution of said first concentrated chemical to a desired concentration, said diluting fluid being introduced through an automatically operable diluting fluid control valve regulating the input flow of said diluting fluid from a supply source thereof;

automatically controlling said pump means said diluting fluid control valve and said selectively controllable valve means by electronic control means in response to a preselected volume and concentration of chemical fluid to discharge the total desired volume of said chemical and diluting fluid at a preselected concentration by providing a predetermined volume flow of said diluting fluid into admixture with said concentrated chemical through said diluting fluid control valve.

* * * * *